US007985114B2

(12) United States Patent
Wei et al.

(10) Patent No.: US 7,985,114 B2
(45) Date of Patent: Jul. 26, 2011

(54) METHOD FOR MAKING FIELD EMISSION LAMP

(75) Inventors: Yang Wei, Beijing (CN); Lin Xiao, Beijing (CN); Feng Zhu, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 890 days.

(21) Appl. No.: 11/951,163

(22) Filed: Dec. 5, 2007

(65) Prior Publication Data

US 2008/0160865 A1 Jul. 3, 2008

(30) Foreign Application Priority Data

Dec. 27, 2006 (CN) ..... 2006 1 0157771

(51) Int. Cl.
*H01J 19/00* (2006.01)
*H01J 19/02* (2006.01)
*H01J 19/24* (2006.01)

(52) U.S. Cl. ..... 445/35; 427/58; 427/64; 427/66; 427/67; 427/105; 427/106; 427/111; 427/112; 427/122; 313/483; 313/495; 313/496; 313/326; 313/346 R; 313/352; 313/355; 313/331; 445/1; 445/23; 445/29; 445/31; 445/38; 445/41; 445/42; 445/43; 445/44; 445/46; 445/49; 445/50; 445/51; 445/53; 445/55; 445/56

(58) Field of Classification Search ..... 427/58, 427/64, 66, 67, 111, 112, 122, 105, 106; 313/483, 495, 496, 346 R, 355; 445/1, 26, 445/29, 31, 35, 38–44, 46, 49–57
See application file for complete search history.

(56) References Cited

U.S. PATENT DOCUMENTS

| | | | | |
|---|---|---|---|---|
| 2004/0151835 | A1 * | 8/2004 | Croci et al. | 427/249.1 |
| 2005/0174059 | A1 * | 8/2005 | Obratzsov | 313/634 |
| 2006/0017370 | A1 * | 1/2006 | Wei et al. | 313/496 |
| 2007/0145878 | A1 * | 6/2007 | Liu et al. | 313/336 |
| 2008/0214082 | A1 * | 9/2008 | Wei et al. | 445/24 |

FOREIGN PATENT DOCUMENTS

JP 62027356 A * 2/1987

OTHER PUBLICATIONS

Croci et al., "A Fully Sealed Luminescent Tube Based on Carbon Nanotube Emission", Microelectronics Journal, vol. 35, pp. 329-336, (2004).* Wei et al., "Cold Linear Cathodes with Carbon Nanotube Emitters and Their Application in Luminescent Tubes", Nanotechnology, vol. 18, pp. (2007).*

* cited by examiner

*Primary Examiner* — Michael Cleveland
*Assistant Examiner* — Lisha Jiang
(74) *Attorney, Agent, or Firm* — Jeffrey T. Knapp

(57) ABSTRACT

A method for making a field emission lamp generally includes the steps of: (a) providing a cathode emitter; (b) providing a transparent glass tube having a carbon nanotube transparent conductive film and a fluorescent layer, wherein the carbon nanotube transparent conductive film and the fluorescent layer are both disposed on an inner surface of the transparent glass tube; (c) providing a first glass feedthrough, a second glass feedthrough, and a nickel pipe, wherein the first glass feedthrough has an anode down-lead pad and an anode down-lead pole connected to the anode down-lead pad, and the second glass feedthrough has a cathode down-lead pole; (d) securing the nickel pipe to one end of the cathode emitter and securing the other end of the cathode emitter to one end of the cathode down-lead pole of the second glass feedthrough; and (e) melting and assembling the first and second glass feedthroughs to ends of the transparent glass tube respectively.

9 Claims, 3 Drawing Sheets

METHOD FOR MAKING FIELD EMISSION LAMP

RELATED APPLICATIONS

This application is related to commonly-assigned application Ser. No. 11/951,160, entitled, "FIELD EMISSION LAMP AND METHOD FOR MAKING THE SAME," filed on Dec. 5, 2007, which is now patented as U.S. Pat. No. 7,780,495. Disclosure of the above-identified application is incorporated herein by reference.

BACKGROUND

1. Field of the Invention

The invention relates to a method for making a field emission lamp.

2. Discussion of Related Art

Electrical lamps for daily living usually include incandescent lamps and fluorescent lamps. Since Thomas Edison invented the first viable incandescent lamps in 1879, the incandescent lamps have a long history for simple fabrication thereof. However, an incandescent lamp emits light by the heating of a tungsten filament and most of the electric energy used to power the lamp is converted into heat and thereby wasted. Therefore, a main shortcoming of the incandescent lamp is the low energy efficiency. Thus, the fluorescent lamps are widely used.

A typical conventional fluorescent lamp generally includes a transparent glass tube. The transparent glass tube has a white or colored fluorescent material coated on an inner surface thereof and a certain amount of mercury vapor filled therein. In use, electrons are accelerated by an electric field and the accelerated electrons collide with the mercury vapor. This collision causes excitation of the mercury vapor and this excitation causes radiation of ultraviolet rays. The ultraviolet rays are absorbed by the fluorescent material and the fluorescent material emits visible light. Compared with the incandescent lamps, the fluorescent lamps have relatively high electrical energy utilization ratios. However, when the glass tube is broken, the mercury vapor is prone to leak out therefrom, and thus, is poisonous and noxious to humans and is environmentally unsafe.

To address the above problems, a kind of fluorescent lamp (i.e., field emission lamp) without mercury vapor has been developed, as can be referenced in an article entitled "A Full Sealed Luminescent Tube Based on Carbon Nanotube Field Emission" and authored by Mirko Croci et al (page 329-336, Vol. 35, Microelectronics Journal 2004). A conventional cold cathode field emission lamp generally includes a transparent glass tube, a cathode, an anode, and glass feedthroughs. The glass feedthroughs are disposed on the ends of the glass tube. The cathode includes a cathode emitter and an electron emission layer formed thereon, and the anode includes a transparent conductive film and a phosphor layer. The transparent conductive film is formed on an inner surface of the glass tube and the phosphor layer is formed on the transparent conductive film facing the electron emission layer. In use, a strong electrical field is provided to excite the cathode emitters. A certain amount of electrons are emitted from the cathode emitters and then accelerated towards and collides with the fluorescent layer of the anode, thereby producing visible light.

The field emission lamp does not adopt mercury vapor, and is safe for humans and environmentally friendly. Furthermore, the field emission lamp adopts a cold cathode, thereby providing a high electrical energy utilization ratio and low energy consumption.

Conventionally, the fabrication of the field emission lamp includes the process of fabricating the cathode emitters, forming the anode, and encapsulating the glass tube. The encapsulation procedure includes connecting the glass feedthroughs with the ends of the glass tube to seal the glass tube. Currently, a colloid is used to connect the glass feedthroughs to the glass tube. However, this sealing method has a poor encapsulation effect and thus affects the performance life of the field emission lamp. Moreover, this method is complicated and time-consuming and not suitable for mass production of the field emission lamp. And thus the field emission lamp has a relatively high cost.

What is needed, therefore, is a method for making a field emission lamp that overcomes the above-mentioned shortcomings, ensuring a high degree of vacuum in the field emission lamp, thus providing a better field emission performance during the use thereof.

SUMMARY

A method for making a field emission lamp generally includes the steps of: (a) providing a cathode emitter; (b) providing a transparent glass tube having a carbon nanotube transparent conductive film and a fluorescent layer, wherein the carbon nanotube transparent conductive film and the fluorescent layer are both disposed on an inner surface of the transparent glass tube; (c) providing a first glass feedthrough, a second glass feedthrough, and a nickel pipe, wherein the first glass feedthrough has an anode down-lead pad and an anode down-lead pole connected to the anode down-lead pad, and the second glass feedthrough has a cathode down-lead pole; (d) securing the nickel pipe to one end of the cathode emitter and securing the other end of the cathode emitter to one end of the cathode down-lead pole of the second glass feedthrough; and (e) melting and assembling the first and second glass feedthroughs to ends of the transparent glass tube respectively.

Other advantages and novel features of the present method for making a field emission lamp will become more apparent from the following detailed description of preferred embodiments when taken in conjunction with the accompanying drawings.

BRIEF DESCRIPTION OF THE DRAWINGS

Many aspects of the present method for making a field emission lamp can be better understood with reference to the following drawings. The components in the drawings are not necessarily to scale, the emphasis instead being placed upon clearly illustrating the principles of the present method for making a field emission lamp.

Figure 1:
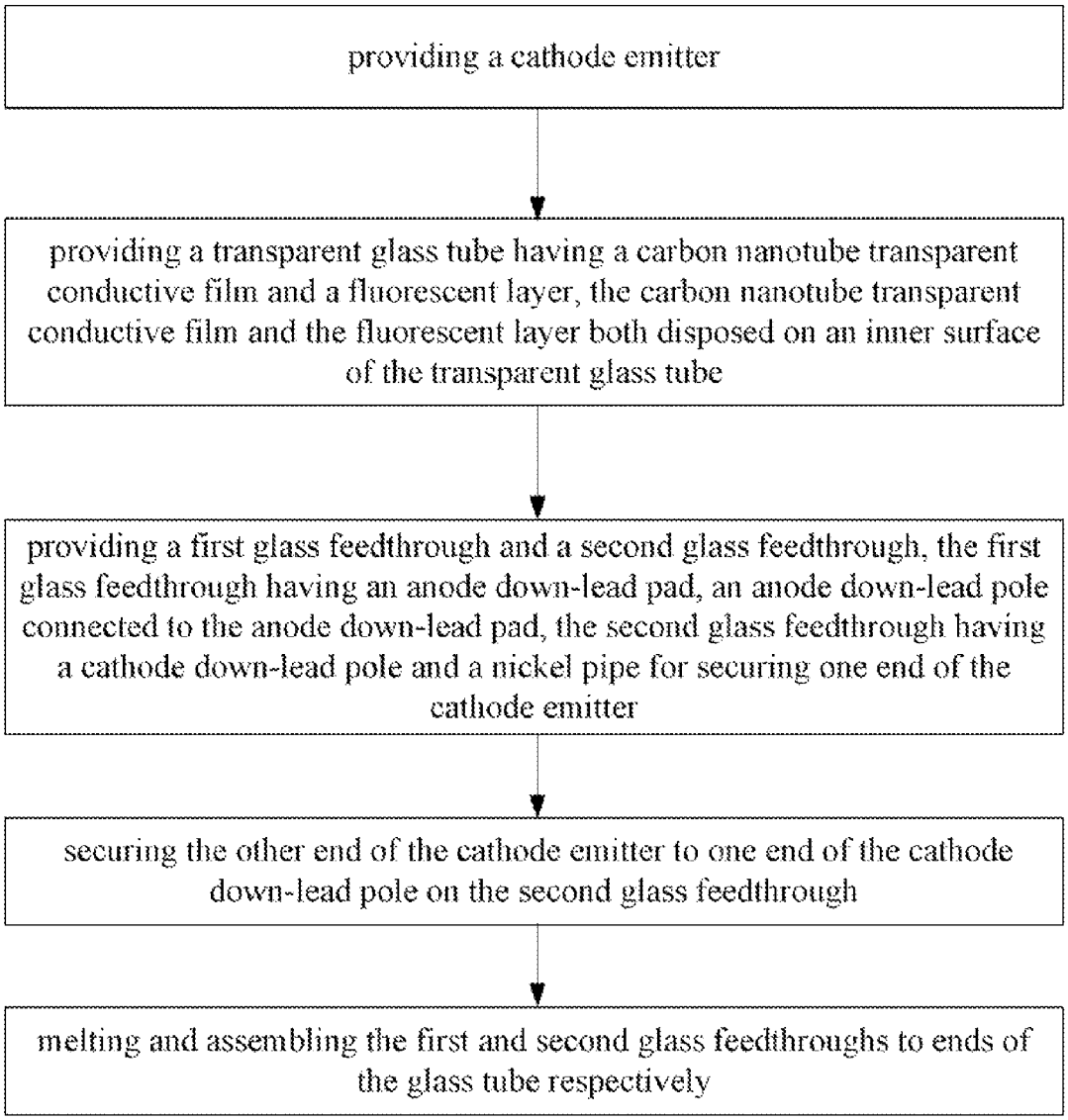
FIG. 1 is a flow chart of a method for making a field emission lamp, in accordance with a first embodiment.

Corresponding reference characters indicate corresponding parts throughout the several views. The exemplifications set out herein illustrate at least one preferred embodiment of the present method for making a field emission lamp, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the present method for making a field emission lamp.

Referring to FIG. 1, a method for making a field emission lamp, in accordance with a first embodiment, generally includes the steps of: (a) providing a cathode emitter; (b) providing a transparent glass tube having a carbon nanotube transparent conductive film and a fluorescent layer, wherein the carbon nanotube transparent conductive film and the fluorescent layer are both disposed on an inner surface of the transparent glass tube; (c) providing a first glass feedthrough, a second glass feedthrough, and a nickel pipe, wherein the first glass feedthrough has an anode down-lead pad and an anode down-lead pole connected to the anode down-lead pad, and the second glass feedthrough has a cathode down-lead pole; (d) securing the nickel pipe to a first end of the cathode emitter and securing a second end of the cathode emitter to one end of the cathode down-lead pole of the second glass feedthrough; and (e) melting and assembling the first and second glass feedthroughs to ends of the transparent glass tube respectively.

In step (a), the cathode emitter includes a conductor and an electron emission layer formed thereon. Step (a) includes the substeps of: (a1) providing at least one pole or wire conductor and preparing a certain amount of a first carbon nanotube slurry and an electro-conductive slurry; (a2) coating a layer of the electro-conductive slurry on the pole or wire conductor and heating the electro-conductive slurry to form an electro-conductive slurry layer, and subsequently coating a layer of the carbon nanotube slurry on the electro-conductive slurry layer and heating the carbon nanotube slurry to form a first carbon nanotube slurry layer thereon; and (a3) drying and baking the pole or wire conductor with the electro-conductive slurry layer and the first carbon nanotube slurry layer at a temperature in an approximate range from about 300° C. to about 600° C., and subsequently subjecting the pole or wire conductor to surface treatment in order to yield an electron emission layer thereon and to obtain the cathode emitter.

In step (a1), the material of the conductor can be formed of a material selected from a group consisting of metal conductive material, doped semiconductor, carbide, conductive oxide, and nitride. The carbon nanotube slurry includes an amount of organic carrier and carbon nanotubes dispersed therein.

Step (a1) further includes the substeps of: (a11) preparing an organic carrier; (a12) forming a carbon nanotube solution by dispersing carbon nanotubes in a dichloroethane solution via crusher and subsequent ultrasonic vibration dispersion; (a13) filtrating the carbon nanotube solution; (a14) adding the carbon nanotube solution to the organic carrier with ultrasonic vibration dispersion; (a15) heating the organic carrier with the carbon nanotubes therein to vaporize the dichloroethane and thus forming the first carbon nanotube slurry.

In step (a11), the organic carrier is an admixture composed of a certain amount of solvent (e.g., terpineol, etc.), and a smaller amount of a plasticizer (e.g., dimethyl phthalate, etc.) and a stabilizer (e.g., ethyl cellulose, etc.). In the present embodiment, the organic carrier is prepared by dissolving the ethyl cellulose in the terpineol in a heating and stirring oil bath and then adding dibutyl phthalate in the solution with continued stirring for a certain period of time, and thus forming the organic carrier. Beneficially, the mass percentages of the terpineol, ethyl cellulose, and dibutyl phthalate in the admixture are about 90%, 5% and 5% respectively. The temperature of the oil bath is in an approximate range from 80° C. to 100° C. Rather appropriately, in the present embodiment, the temperature of the oil bath is 100° C. The stirring takes 10 to 25 hours, and rather appropriately, in the present embodiment, the stirring takes 24 hours.

In step (a12), the carbon nanotubes can be prepared by means of chemical vapor deposition, arc discharge method, laser evaporation method, and other existing technologies. A length of the carbon nanotubes is in the approximate range from 1 micrometer to 100 micrometers. A diameter of each carbon nanotube is in an approximate range from 1 nanometer to 100 nanometers. The ratio of the carbon nanotube to the dichloroethane is, beneficially, 2 g (gram) carbon nanotubes per about 500 ml (milliliter) dichloroethane. The dispersion time via crusher is, beneficially, in an approximate range from 5 to 30 minutes, and rather beneficially, in the present embodiment, the dispersion time via crusher is 20 minutes. The dispersion time via ultrasonic vibration is, appropriately, in an approximate range from 10 to 40 minutes, and rather appropriately, in the present embodiment, the ultrasonic vibration dispersion time via crusher is 30 minutes.

In step (a13), the carbon nanotubes can be filtrated via a boult. Advantageously, the carbon nanotubes can be filtrated via a boult with 400 mesh to obtain carbon nanotubes with the appropriate length and diameter.

In step (a14), the mass percentage of the carbon nanotubes to the organic carrier is, beneficially, 1:15. The time of the ultrasonic dispersion is, beneficially, 30 minutes. In step (a15), the temperature of the water bath is, advantageously, 90° C.

In step (a1), the electro-conductive slurry includes a certain amount of glass particles and conductive metal particles. The glass particles are, opportunely, glass with a low melting point in an appropriate range from 350° C. to 600° C. A diameter of the particles is, advantageously, in an approximate range from 10 to 100 nanometers. The conductive metal particles are made of conductive material, such as silver, or indium tin oxide. The conductive metal particles can be pretreated by milling via a ball mill. A diameter of the conductive metal particles is, beneficially, in an approximate range from 0.05 to 2 micrometers. The electro-conductive slurry is an admixture composed of a certain amount of solvent (e.g., terpineol, etc.), and a smaller amount of a plasticizer (e.g., dimethyl phthalate, etc.) and a stabilizer (e.g., ethyl cellulose, etc.). The mixing of the admixture is conducted in an approximate temperature range from 60° C. to 80° C. for about 3 to 5 hours. Advantageously, an ultrasonic vibration with low power and subsequently, a centrifugal treatment are further adopted to treat the organic solvent with glass particles and conductive metal particles.

In step (a2), the process of the coating is under a clean condition with, beneficially, the amount of dust being less than 1000 mg/m$^3$. Advantageously, hot air is used to dry the electro-conductive slurry and carbon nanotube slurry to form an electro-conductive slurry layer and a first carbon nanotube slurry layer on the pole or wire conductor. A thickness of the electro-conductive slurry layer is, beneficially, in an approximate range from a few microns to tens of microns.

In step (b), the fluorescent layer is formed on the carbon nanotube transparent conductive film, and a portion of the carbon nanotube transparent conductive film near the end thereof is not covered by the fluorescence layer and thus forms an uncovered portion. Beneficially, a colloidal graphite layer is disposed under the uncovered portion.

Step (b) mainly includes the substeps of: (bl) preparing a second carbon nanotube slurry; (b2) forming a second carbon nanotube slurry layer on the inner surface of the transparent glass tube by coating and drying the second carbon nanotube slurry thereon; (b3) forming a fluorescent layer on the second carbon nanotube slurry layer; (b4) heating the transparent glass tube with the second carbon nanotube slurry layer and the fluorescent layer to a temperature in a range from 300° C. to 500° C. and keeping the transparent glass tube at that temperature in a nitrogen ($N_2$) or a noble gas atmosphere, and then cooling the transparent glass tube to room temperature, to form the carbon nanotube transparent conductive film and the fluorescent layer.

In step (b1), the method for making the second carbon nanotube slurry is similar to the method for making the first carbon nanotube slurry except for heating the organic carrier with the carbon nanotubes therein in a water bath to a suitable concentration to form the second carbon nanotube slurry. The concentration of the carbon nanotubes in the second carbon nanotube slurry affects the light transparency property and conductive property of the carbon nanotube transparent conductive film. When the concentration of the carbon nanotubes in the second carbon nanotube slurry is relatively high, the carbon nanotube transparent conductive film has low transparency but excellent conductivity and vice versa. Beneficially, an amount of about 2 g carbon nanotubes and an amount of 500 ml dichloroethane solution are mixed together to form a carbon nanotube solution. The carbon nanotube and the organic carrier with a mass percentage ratio of about 1:15 are mixed together and then are heated in a water bath to vaporize the organic carrier, and thus form 200 ml of the second carbon nanotube slurry. The temperature of the water bath is, opportunely, about 90° C.

Step (b2) includes the substeps of: (b21) encapsulating one end of the transparent glass tube and placing the encapsulated end thereof downward along a vertical direction; (b22) pouring the carbon nanotube slurry into the transparent glass tube; (b23) opening the encapsulated end, and the carbon nanotube slurry, under the influence of gravity, flowing down naturally; (b24) part of the carbon nanotube slurry, via adsorption effect, forming the carbon nanotube slurry layer on the inner surface of the transparent glass tube. This process is conducted under a clean condition, with the amount of dust in the air being less than 1000 mg/m$^3$.

In step (b3), the fluorescent layer can be formed by means of coating, deposition, screen-printing, and other available technologies. The fluorescent material can be selected from monochromatic fluorescent material or colored fluorescent material according to the actual application. In step (b4), the heating temperature is, beneficially, 320° C., and the holding time is, advantageously, 20 minutes.

In step (c), an exhaust tube and two inspiratory devices with non-evaporating getters are located at the second glass feedthrough. An anode down lead connects the anode down-lead pad and the anode down-lead pole.

Step (e) includes the substeps of: (e1) securing the second glass feedthrough that secures the cathode emitter along a vertical direction, fixing one end of the transparent glass tube with carbon nanotube transparent conductive film and fluorescent layer to the second glass feedthrough, rotating the transparent glass tube with the carbon nanotube transparent conductive film and fluorescent layer thereon around a shaft of the transparent glass tube, and heating an interface between the second glass feedthrough and the transparent glass tube to melt and assemble together the second glass feedthrough and the transparent glass tube; and (e2) fixing the first glass feedthrough on the other end of the transparent glass tube, locating the nickel pipe on the first end of the cathode emitter, fixing the anode down-lead pad on the uncovered portion of the carbon nanotube transparent conductive film, rotating the first glass feedthrough and the transparent glass tube around the shaft of the transparent glass tube, and heating an interface between the first glass feedthrough and the transparent glass tube to melt and assemble together the first glass feedthrough and the transparent glass tube.

The method for making the field emission lamp further includes a step (f) of: connecting the transparent glass tube assembled with the glass feedthroughs to a super-vacuum syfeedthrough, via an exhaust tube, baking, exhausting, and then airproofing the exhaust tube, and thus forming the field emission lamp. The baking temperature is, beneficially, 350° C. and the exhausting time is, advantageously, 2 hours. During the exhausting process, the non-evaporating getters are activated in the inspiratory devices.

Figure 2:
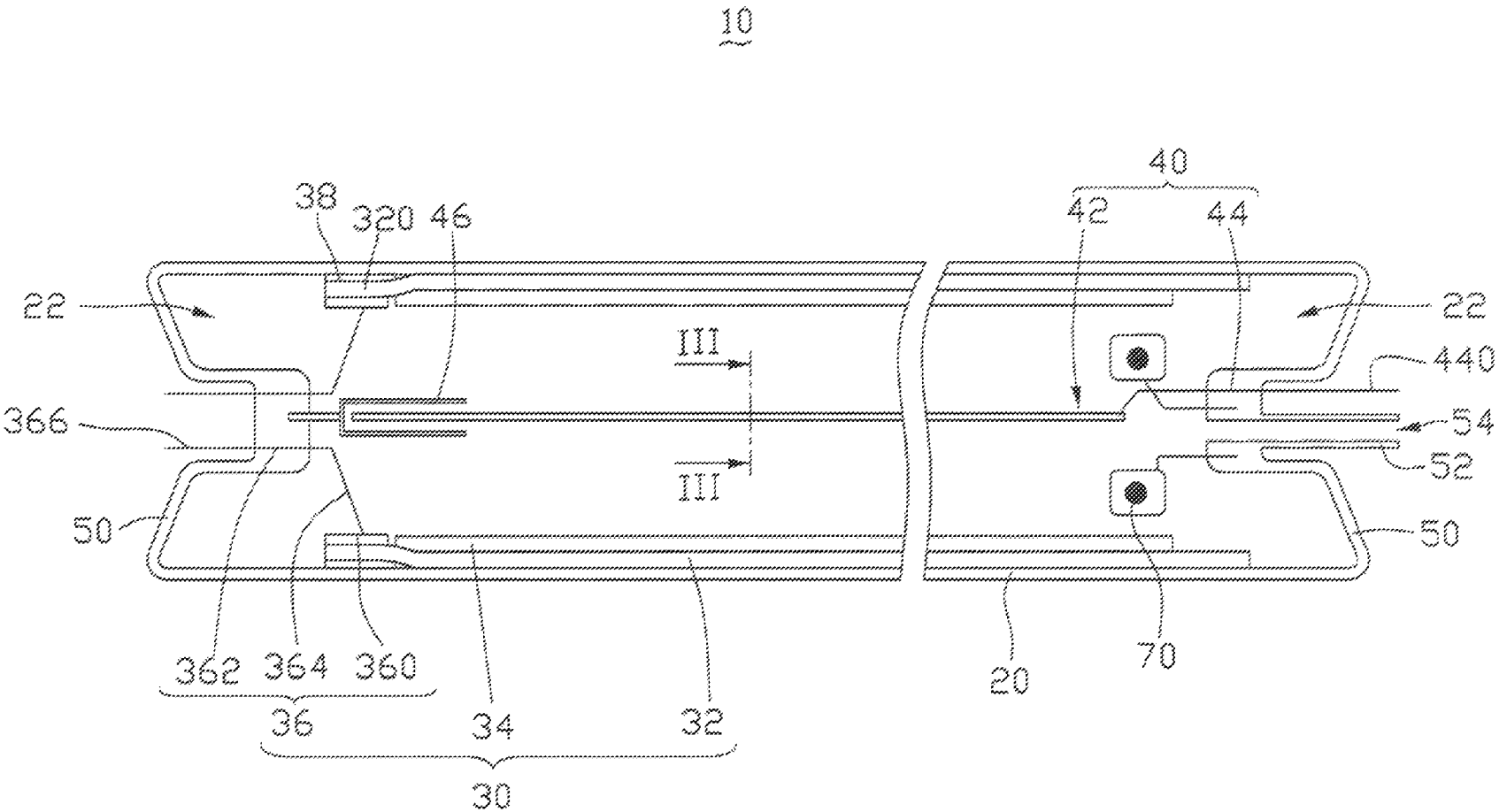
FIG. 2 shows a structural schematic view of a field emission lamp, made by the method of FIG. 1.

Referring to FIG. 2, a field emission lamp manufactured by the present method is shown. The field emission lamp 10 includes a transparent glass tube 20, an anode 30, a cathode 40, two glass feedthroughs 50, and an inspiratory device 70.

The transparent glass tube 20 has two open ends 22. The two glass feedthroughs 50 are melted and assembled on the two open ends 22 respectively and form an airproof space. An exhaust tube 52 is disposed on one of the glass feedthrough 50. One end of the exhaust tube 52 is connected to the airproof space of the transparent glass tube 20 and the other end thereof extended outside of the glass feedthrough 50 to form a vent 54.

The anode 30 includes a carbon nanotube transparent film 32 formed on an inner surface of the transparent glass tube 20, a fluorescent layer 34 formed on the carbon nanotube transparent film, and an external connection electrode 366 supplied by an anode electrode 36. The fluorescence layer 34 covers the carbon nanotube transparent film 32 except for a portion thereof near the anode electrode 36 and thus forms an uncovered area 320. A colloidal graphite layer 38 is, beneficially, disposed under the uncovered area 320. The anode electrode 36 includes an anode down-lead pad 360, an anode down-lead pole 362, and an anode down-lead 364.

Figure 3:
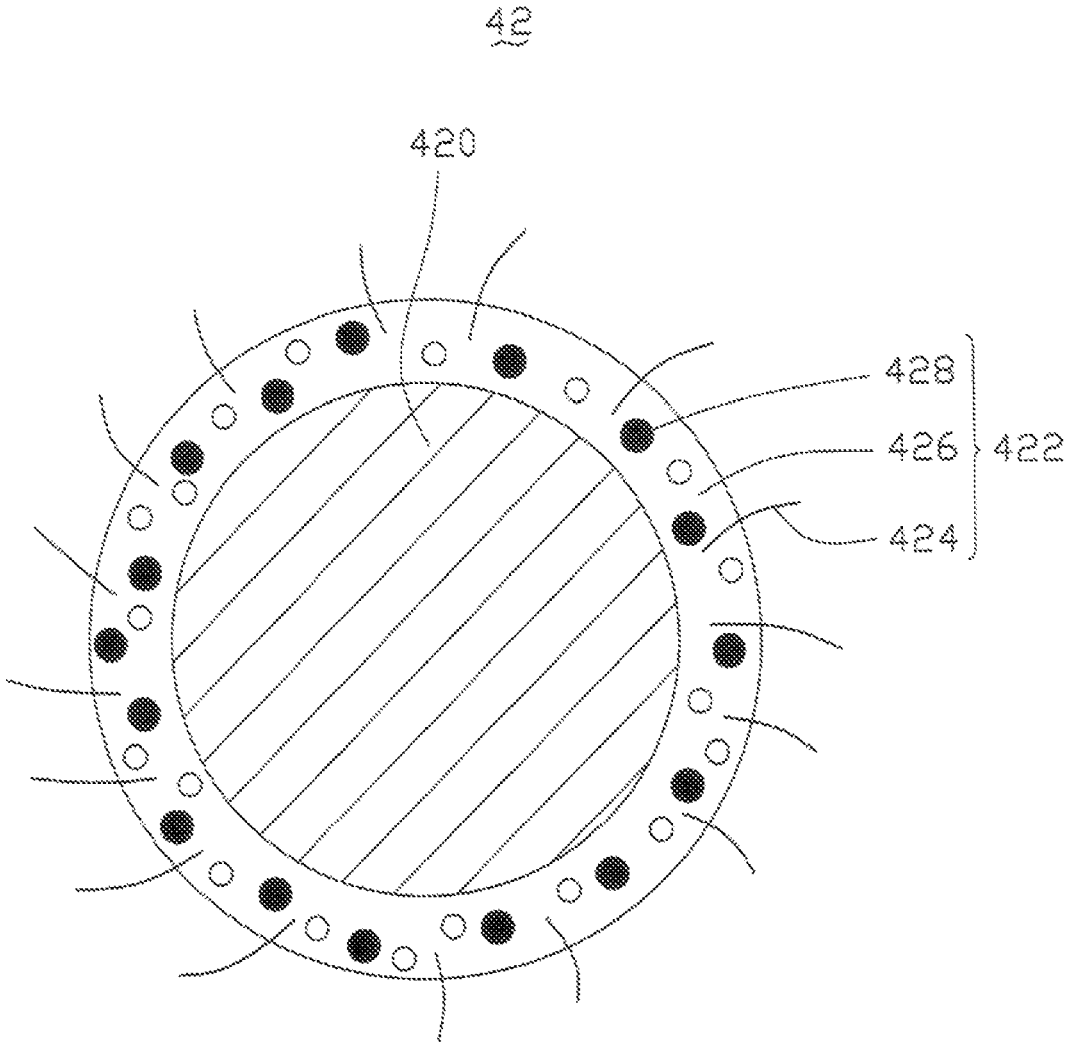
FIG. 3 shows a sectional view of a field emission lamp along a line III-III of FIG. 2.

The cathode 40 includes a cathode emitter 42 and an external connection electrode 440 supplied by a cathode electrode 44. The cathode emitter 42 has a first end and a second end. The second end of the cathode emitter 42 is fixed to the cathode electrode 44, and the first end thereof is disposed to a nickel pipe 46 fixed on the glass feedthrough 50. Referring to FIG. 3, the cathode emitter 42 includes a conductor 420 and an electron emission layer 422 formed thereon. The electron emission layer 422 includes glass 426, a plurality of carbon nanotubes 424 dispersed in the glass tube and conductive metal particles 428. Quite suitably, a diameter of the conductor 420 is in the approximate range from 0.1 to 2 millimeters. The material of the conductor 420 can, beneficially, be any kinds of conductive metals or alloys thereof. In one useful embodiment, the conductor 420 is made of nickel (Ni). A length of the carbon nanotubes is in the approximate range from 1 to 100 microns, and a diameter thereof is in the approximate range from 1 to 100 nanometers. The cathode electrode 44 is the cathode down-lead pole.

Compared with conventional methods for making a field emission lamp, the method for making a field emission lamp in the described embodiments adopts melting and assembling the glass feedthroughs directly onto the ends of the transparent glass tube to form a hermetical space. This effectively simplifies the encapsulation procedure during the manufacturing process, thereby enhancing a production rate, reducing the cost of the field emission lamp and is suitable for mass production. The field emission lamp made by the described embodiments has an excellent encapsulation effect.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for making a field emission lamp, comprising the steps of:

(a) providing a cathode emitter;

(b) providing a transparent glass tube having a carbon nanotube transparent conductive film and a fluorescent layer, wherein the carbon nanotube transparent conductive film and the fluorescent layer are both disposed on an inner surface of the transparent glass tube;

(c) providing a first glass feedthrough, a second glass feedthrough, and a nickel pipe, wherein the first glass feedthrough has an anode down-lead pad and an anode down-lead pole connected to the anode down-lead pad, and the second glass feedthrough has a cathode down-lead pole;

(d) securing the nickel pipe to a first end of the cathode emitter and securing a second end of the cathode emitter to one end of the cathode down-lead pole of the second glass feedthrough; and (e) melting and assembling the first and second glass feedthroughs to two opposite ends of the transparent glass tube respectively.

2. The method as claimed in claim 1, wherein step (e) comprises the substeps of:

(e1) securing the second glass feedthrough that secures the cathode emitter along a vertical direction, fixing one end of the transparent glass tube with carbon nanotube transparent conductive film and fluorescent layer to the second glass feedthrough, rotating the transparent glass tube with the carbon nanotube transparent conductive film and fluorescent layer thereon around a shaft of the transparent glass tube, and heating an interface between the second glass feedthrough and the transparent glass tube to melt and assemble together the second glass feedthrough and the transparent glass tube; and (e2) fixing the first glass feedthrough on the other end of the transparent glass tube, locating the nickel pipe on the first end of the cathode emitter, fixing the anode down-lead pad on an uncovered portion of the carbon nanotube transparent conductive film, rotating the first glass feedthrough and the transparent glass tube around the shaft of the transparent glass tube, and heating an interface between the first glass feedthrough and the transparent glass tube to melt and assemble together the first glass feedthrough and the transparent glass tube.

3. The method as claimed in claim 1, wherein step (a) comprises the substeps of:

(a1) providing at least one pole or wire conductor and preparing a certain amount of a first carbon nanotube slurry and an electro-conductive slurry;

(a2) coating a layer of electro-conductive slurry on the at least one pole or wire conductor and heating the electro-conductive slurry to form an electro-conductive slurry layer, and subsequently coating a layer of the carbon nanotube slurry on the electro-conductive slurry layer and heating the carbon nanotube slurry to form a first carbon nanotube slurry layer thereon; and (a3) drying and baking the at least one pole or wire conductor with the electro-conductive slurry layer and the first carbon nanotube slurry layer at a temperature in an approximate range from about 300° C. to about 600° C., and subsequently subjecting the at least one pole or wire conductor to surface treatment in order to yield an electron emission layer thereon and to obtain the cathode emitter.

4. The method as claimed in claim 3, wherein step (a1) further comprises the substeps of:

(a11) preparing an organic carrier;

(a12) forming a carbon nanotube solution by dispersing carbon nanotubes in a dichloroethane solution via crusher and subsequent ultrasonic vibration dispersion;

(a13) filtrating the carbon nanotube solution;

(a14) adding the carbon nanotube solution to the organic carrier with ultrasonic vibration dispersion;

(a15) heating the organic carrier with the carbon nanotubes therein to vaporize the dichloroethane and thus forming the first carbon nanotube slurry.

5. The method as claimed in claim 4, wherein in step (a11), the organic carrier is prepared by dissolving the ethyl cellulose in the terpineol in a heating and stirring oil bath and then adding dibutyl phthalate in with continued stirring for a certain period of time, and thus forming the organic carrier.

6. The method as claimed in claim 4, wherein in step (a1), the electro-conductive slurry comprises an amount of glass particles and conductive metal particles, and is formed by mixing the glass particles and conductive metal particles in the organic carrier in an approximate temperature range from 60° C. to 80° C. for about 3~5 hours.

7. The method as claimed in claim 1, wherein step (b) comprises the substeps of:

(b1) preparing a second carbon nanotube slurry;

(b2) forming a second carbon nanotube slurry layer on the inner surface of the transparent glass tube by coating and drying the second carbon nanotube slurry thereon;

(b3) forming a fluorescent layer on the second carbon nanotube slurry layer;

(b4) heating the transparent glass tube with the second carbon nanotube slurry layer and the fluorescent layer to a temperature in a range from 300° C. to 500° C. and keeping the transparent glass tube at that temperature in a nitrogen ($N_2$) or a noble gas atmosphere, and then cooling the transparent glass tube to room temperature, to form the carbon nanotube transparent conductive film and the fluorescent layer.

8. The method as claimed in claim 1, wherein an exhaust tube and two inspiratory devices with getters are located at the second glass feedthrough.

9. The method as claimed in claim 1, further comprising step (f) of: connecting the transparent glass tube assembled with the glass feedthroughs to a super-vacuum system, via an exhaust tube, baking, exhausting, and then airproofing the exhaust tube, and thus forming the field emission lamp.

* * * * *